US005664555A

United States Patent [19]

Maschhoff et al.

[11] Patent Number: 5,664,555

[45] Date of Patent: Sep. 9, 1997

[54] WALL HEATER WITH IMPROVED HEAT EXCHANGER

[75] Inventors: Lloyd R. Maschhoff, Belleville, Ill.; Thomas D. Vaughn, Ballwin, Mo.

[73] Assignee: Empire Comfort Systems, Inc., Belleville, Ill.

[21] Appl. No.: 522,761

[22] Filed: Sep. 1, 1995

[51] Int. Cl.[6] ..... F24H 3/02

[52] U.S. Cl. ..... 126/110 B; 126/116 B; 126/91 A; 165/150; 165/DIG. 497

[58] Field of Search ..... 126/91 A, 110 R, 126/110 B, 110 D, 116 B; 165/150, DIG. 497, DIG. 495

[56] References Cited

U.S. PATENT DOCUMENTS

| | | | |
|---|---|---|---|
| 1,929,937 | 10/1933 | Slagel | 165/150 |
| 4,344,482 | 8/1982 | Dietzsch | 165/150 |
| 4,467,780 | 8/1984 | Ripka . | |
| 4,580,623 | 4/1986 | Smitte et al. | 165/150 |
| 5,178,124 | 1/1993 | Lu et al. | 126/110 R |
| 5,207,074 | 5/1993 | Cox et al. | 165/150 |

OTHER PUBLICATIONS

Advertisement for Diamond 80 by York® Heating and Air Conditioning, source unknown, date unknown, one page.

*Primary Examiner*—Carroll B. Dority
*Attorney, Agent, or Firm*—Howell & Haferkamp, L.C.

[57] ABSTRACT

A forced air, wall heater includes a heat exchanger which has a plurality of tubes. Each of the tubes include substantially parallel aligned runs and at least one return section between adjacent runs. The return section is aligned generally perpendicular with each of the plurality of runs. The heater also includes a blower positioned for blowing air directly toward the return section to maximize the mass flow rate of air over the return section. At least two of the runs are offset both laterally and in the direction of air flow with respect to each other. The ordering of tubes differs in at least two positions within the exchanger.

17 Claims, 3 Drawing Sheets

WALL HEATER WITH IMPROVED HEAT EXCHANGER

BACKGROUND OF THE INVENTION

Many different types of heating units are used in residential and commercial buildings to heat the interior of those buildings. One of these different types of heating units is a forced air gas-fueled unit. Frequently, these units are located centrally within the building and duct work extends to registers positioned throughout the building. These units include a burner for heating air drawn into the unit and a fan or blower for forcing the heated air through the duct work to deliver the air to the registers. Usually, some type of heat exchanger is used to heat the air so that the heated air and combusted gases do not mix. Because the combusted gases from the burner include high concentrations of carbon monoxide which are hazardous to humans, circulating the combusted gases throughout the building is not desirable.

These centrally-located, forced-air, gas-fueled heating units are highly efficient and work well for many applications. However, in some applications the heaters are not desirable. For example, in hotels and motels it is desirable to permit the temperature in each room to be individually controlled as each guest may be comfortable when the air is within a different temperature range. In order to achieve widely varying temperatures from room to room, separate heater units are frequently employed. Further, because the size of a hotel room or suite is typically not as large as an entire house, the relatively large centrally located furnaces used in houses are too large for use in individual hotel rooms. Thus, smaller heaters are desirable in hotel rooms. These smaller heaters are compact, and are generally designed to be positioned against an exterior wall of the room to maximize the useable floor space in the room. As a result, these smaller heaters are commonly referred to as "wall heaters".

Another example where smaller heaters are desirable is in additions to existing buildings. For small additions, it is frequently uneconomical to re-route and/or add onto the existing duct work. Further, sometimes even when the duct work could be re-routed economically, the added load on the existing furnace would be so great as to prevent it from effectively heating the building. Thus, rather than re-route the existing duct work or replace the existing furnace, it is sometimes desirable to use a smaller second furnace in additions to existing buildings.

Typically forced-air, gas-fueled wall heaters are comprised of a cross-flow heat exchanger, a blower positioned to force air from the room past pipes in the heat exchanger, and a burner for heating air flowing through the pipes. In addition, most wall heaters include various control systems and sensors which regulate the heater and shut down operation when the sensors measure certain undesirable conditions. Prior art heater units usually include only one blower which is generally directed to force air over the central portion of the heat exchanger. The heat exchangers in these units may take one of several different configurations. Typically, however, the exchangers include a mixed stream flowpath and an unmixed stream flowpath. As the name suggests, the mixed stream flowpath is configured to permit the air to circulate as it travels through the exchanger so that the air emerges from the exchanger at a uniform temperature. In contrast, the unmixed stream flowpath is configured to inhibit the air from mixing. The burner is usually placed in series with the unmixed stream flowpath and the air from the room is usually forced along the mixed stream flowpath.

Thus, the combusted gases travel through the unmixed stream flowpath and the heated air travels through the mixed stream flowpath and emerges at a uniform temperature.

Regardless of the actual configuration used, wall furnaces are more desirable when they are more efficient, less expensive and smaller. The ever increasing cost of energy and the highly competitive nature of the HVAC industry drive heater manufacturers to constantly seek to improve the efficiencies of their heaters. Higher heater efficiencies reduce fuel consumption thereby reducing the consumer's heating costs and improving their salability. As with most consumer goods, the less expensive they can be manufactured without compromising effectiveness, durability, and quality, the more desirable the product is to the purchasing public. Therefore, the less expensive a manufacturer can make a heater without sacrificing quality and efficiency, the better. Finally, because the space in hotel rooms and new construction is at a premium, the smaller a heater unit can be made, the more desirable it is.

SUMMARY OF THE INVENTION

The heater of the present invention includes a high efficiency cross-flow heat exchanger which is designed in a compact size. Further, the heat exchanger is uniquely designed to have an increased efficiency. The heat exchanger is formed by one or more serpentine tubes carrying the combusted gas upward through the exchanger and the surrounding duct directs the air downward across the tubes. The tubes are positioned entirely within the duct so that the maximum heat transfer surface area is utilized. Each heat exchanger tube is comprised of horizontal runs connected by arcuate return sections. Two blowers are used in the heater to force air downward through the heat exchanger, downward being the most desired. The blowers are positioned directly over the return sections of the heat exchanger tubes to maximize their thermal efficiency. Therefore, high heat transfer coefficients are achieved throughout the heat exchanger interior. In addition, the heat exchanger tubes are nested to provide a compact size and so that air flowing through the heat exchanger duct is directed over different tubes as it passes through the duct. This results in a more uniform temperature distribution in the air flowing through the duct than would otherwise be available.

BRIEF DESCRIPTION OF THE DRAWINGS

Further objects and features of the present invention are revealed in the following Detailed Description of the Preferred Embodiment of the invention and in the drawing figures wherein.

DETAILED DESCRIPTION OF THE PREFERRED EMBODIMENT

Figure 1:
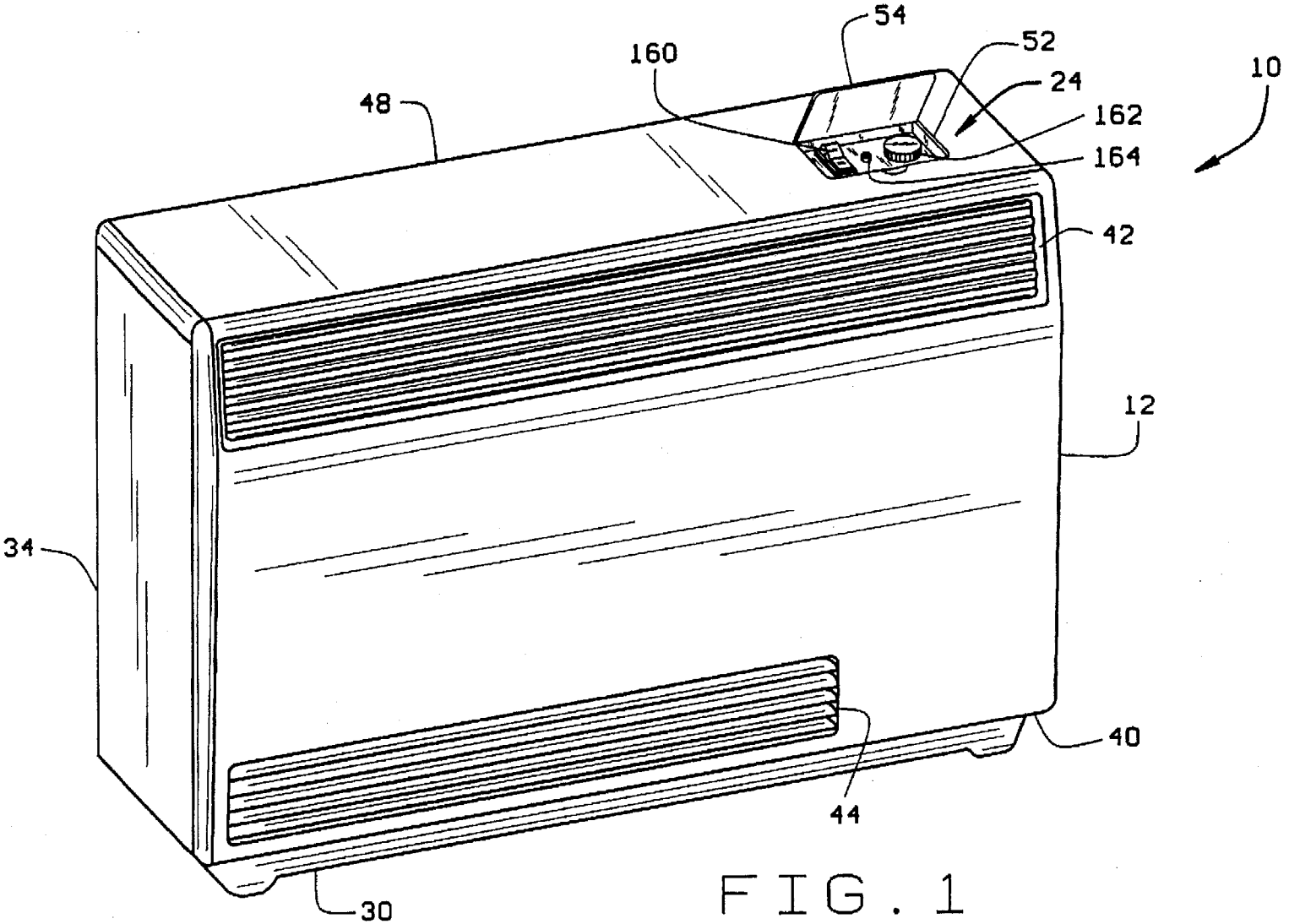
FIG. 1 is an orthographic projection of the exterior of the heater casing of the present invention.
Figure 2:
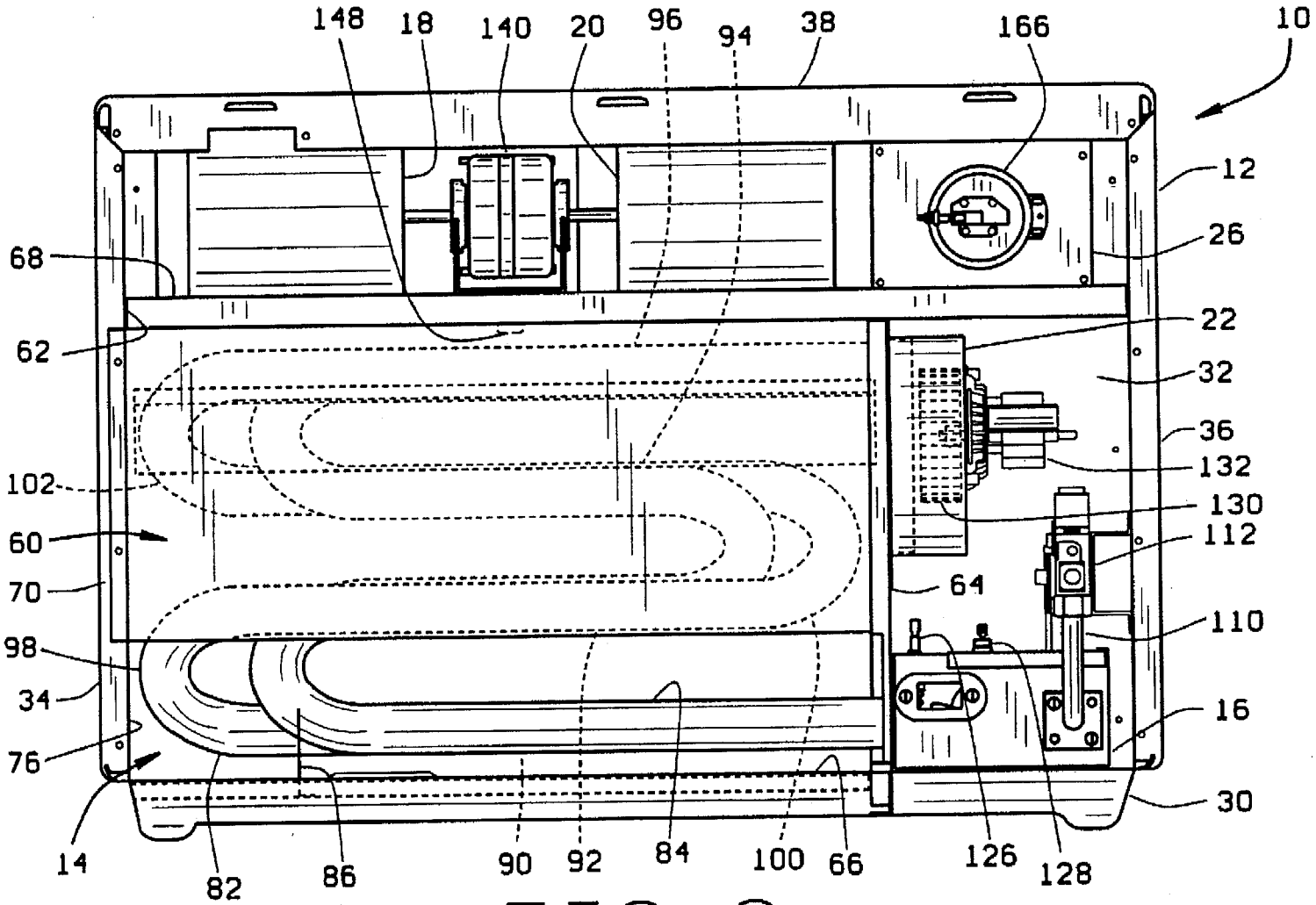
FIG. 2 is a front elevation view of the heater of the present invention shown without the casing front.

The heater 10 of the preferred embodiment is of the type configured for installation within a residential or commercial building along an exterior wall of the structure. This type of heater is commonly referred to as a "wall heater". As best seen in FIG. 2, the heater 10 of the preferred embodiment is generally comprised of a casing 12 which houses a cross-flow heat exchanger 14, a gas burner 16, two centrifugal blowers 18, 20 for forcing the room air through the mixed stream flowpath of the heat exchanger, a centrifugal inducer blower 22 for drawing the combusted gases upward through the unmixed stream flowpath of the heat exchanger, and a system control panel 24 (see FIG. 1) with an electronic controller 26 which includes sensors for measuring the ambient and system conditions and altering the system operation in response to changes in the control panel settings and the ambient and system conditions.

The casing 12 includes a base 30 which has an integral back panel 32, as well as, left and right side panels 34, 36, a top panel 38 and a front panel 40. Each of these casing components is stamped from sheet metal and assembled using sheet metal screw fasteners as is well-known in the industry. As shown in FIG. 1, the front casing panel 40 includes a false upper grill 42 for decoration and a working lower exhaust grill 44. The integral back panel 32 includes three air intake openings 46, 48, 50 through which air is drawn from the ambient surroundings within the room into the heater casing. Once heated, the air is forced out of the casing through the exhaust grill 44 at the lower side of the front casing panel 40. A control panel access opening 52 is provided in the top casing panel 38 and a door 54 is pivotally connected to the top casing panel with a hinge (not shown) to cover the control panel access opening when the control panel 24 is not being adjusted.

The heat exchanger 14 is housed within a duct 60 positioned inside the casing 12. The duct 60 is comprised of left and right sheet metal shields 62, 64 which are located inside the left and right side panels 34, 36 of the case 12 and assembled with sheet metal screw fasteners to the back panel 32 of the casing base 30. Bottom, top and front shields 66, 68, 70 are positioned inside the respective casing panels and fastened to the left and right shields 62, 64 to complete the duct 60. The back panel 32 of the casing base 30 forms the rearward side of the duct 60. Two intake ports (not shown) in the top shield 68 form the intake end of the duct 60. The front shield 70 is fastened to the left and right shields 62, 64 at a position spaced above the base 30 so that an exhaust port 76 is formed between the front shield and casing base behind the exhaust grill 44. The exhaust port 76 forms the exhaust end of the duct. The shields forming the duct are spaced from the casing to form a dead air space. This space thermally insulates the casing from the duct to prevent the casing from becoming hot to the touch.

First, second and third serpentine exchanger tubes 80, 82, 84 are attached to the right shield 64 of the duct 60. Holes (not shown) are punched in the right shield 64 adjacent the ends of the exchanger tubes 80, 82, 84 to provide the inlets to and the outlets from the tubes. A bracket 86 is attached to the bottom shield between the left and right shields 62, 64 to cradle the serpentine exchanger tubes 80, 82, 84 along their lengths thereby holding them in position and reducing the stresses in the tubes and adjoining components.

Figure 4:
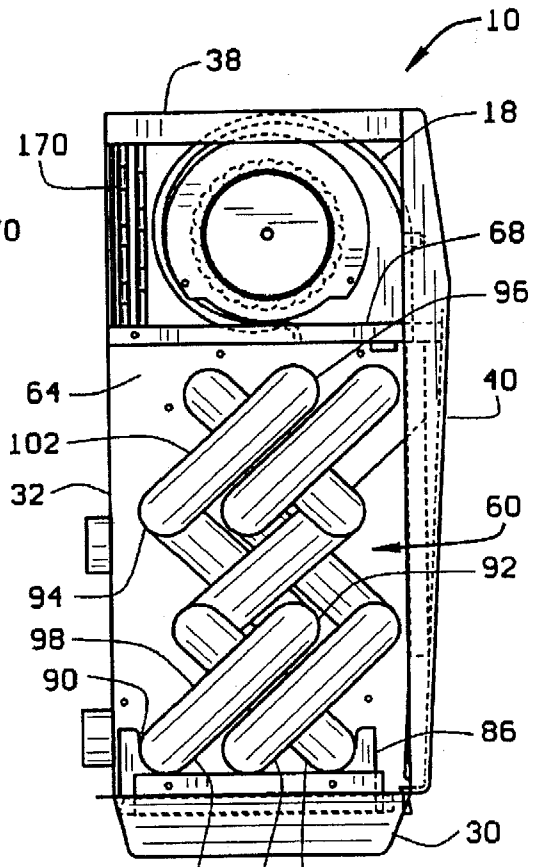
FIG. 4 is a left side elevation view shown without the left caring panel and shield to expose the internal components.

The first serpentine exchanger tube 80 includes first, second, third and fourth runs 90, 92, 94, 96 separated by first, second and third return sections 98, 100, 102. The second and third serpentine exchanger tubes 82, 84 have similar runs and return sections. As best seen in FIG. 4, the return sections of each heat exchanger tube are perpendicular with respect to each other and obliquely oriented relative to the front shield 70 so that the first and third runs are both horizontally and vertically offset from the second and forth runs. Thus, each exchanger tube has a contorted Z-shape when viewed from the side. The first and second exchanger tubes 80, 82 are identically shaped and parallel one another in the preferred embodiment. The third serpentine exchanger tube 84 is designed with shorter runs than the other tubes and the oblique orientations of the return sections of the third tube are opposite those of the other tubes so that the third tube compactly nests within the envelope of the first and second exchanger tubes. Thus formed, the heat exchanger 14 of the preferred embodiment has a cross-flow configuration. In other words, the predominant direction of air flow within the exchanger tubes is generally perpendicular to the direction of air flow through the duct in general. Cross-flow results in higher heat transfer coefficients than does parallel flow. Thus, the efficiency of the heater is increased by using a cross-flow heat exchanger rather than a parallel design.

The particular tube configuration described above has several advantages. In some heaters, each exchanger tube is configured to lie in a single plane. Thus, when multiple tubes are used, air travelling through the duct tends to contact different runs of the same tube rather than different tubes. Because the different burners may not heat the air travelling through the different tubes to the same temperature, the air travelling through the duct may not be uniformly heated. As a result, convective currents which reduce the heater performance can develop within the heat exchanger. Each exchanger tube in the heat exchanger of the preferred embodiment is a contorted a Z-shape and the runs of each tube are positioned at different forward and rearward locations within the heat exchanger. Further, because the third tube contorted Z-shape is opposite those of the first and second tubes, the tubes are ordered in different sequences forward to rearward at different levels within the exchanger. Thus, at one level the first tube may be at the rearward-most position and at the next level another tube may be in the rearward-most position. If either of these tubes had an abnormal temperature relative to the other tubes, the temperature effect on the air passing over the abnormal temperature tube is equalized by the temperature of the tube which is encountered at the next level. Therefore, the thermal gradients in the air traveling through the duct are further reduced by the reverse-Z pattern.

The equalization of temperature gradients normal to the direction of air travel through the heat exchanger is further improved by the serpentine configuration of each of the exchanger tubes. As hot air travels through the tubes from the inlet adjacent the burner to the outlet adjacent the inducer, its temperature drops due to heat transfer through the tube to the air passing through the duct. Because the exchanger tubes run serpentine through the heat exchanger, the hotter end of each run of each tube is adjacent the colder end of the next run. As a result, air passing over the colder end of a run does not pick up as much heat as the air passing over the hotter end. However, as the air passing over each colder end continues on through the duct to the next run, it encounters a hotter end. Thus, the temperature differential along the length of the runs is continuously compensated for as the air passes between adjacent runs. This continuous compensation minimizes thermal gradients normal to the direction of air flow through the duct.

Although prior art centrally-located, forced-air, gas-fueled heating units used serpentine exchanger tubes, the serpentine configuration in those units was generally planar rather than a contorted Z-shape. As flow restrictions in tubes increase with tighter radii of curvature and the distance between runs in planar tubes may only be decreased by reducing the radius of curvature of the return sections, the prior art planar serpentine tubes had a practical minimum height limit which could not be reduced without causing significant flow restrictions. Because the practical height of wall heaters is limited, the use of several runs in any one tube was prohibited as a result of the minimum height limit inherent with the prior art planar serpentine exchanger tubes. However, the contorted Z-shape of the tubes of the present invention enables shorter exchangers to be made with more runs thereby permitting the effective use of serpentine tube heat exchangers in wall heaters. In addition, the Z-shape and reverse-Z enable the tubes to be nested thereby further optimizing the use of space and increasing the heater performance.

The gas burner 16 is positioned adjacent the inlets of the serpentine exchanger tubes 80, 82, 84. Although the configuration of the burner differs slightly depending upon whether liquified petroleum (LP) gas, natural gas or another fuel source is intended to be burned, the burner 16 is generally comprised of a manifold 110 having a flow regulator 112 positioned along its length. Holes (not shown) are machined into the side of the manifold 110 and orifices (not shown) are threaded into the manifold holes. The orifices are generally aligned with the exchanger tube inlets. As is common in the industry, flame holder assemblies (not shown) having carburetors along their lengths are positioned adjacent the orifices to mix air drawn in through the inlet port 114 with the gas which is blown from the orifices. The carburetors are adjustable so that the amount of air which is mixed with the gas may be altered to produce an optimally burning mixture. The flame holders are configured to direct the flame from the burner into the inlets of the exchanger tubes 80, 82, 84. An electronic spark ignitor (not shown) is positioned within the burner 16 adjacent the flame holders to ignite the gas-and-air mixture and light the burner. Thus, the need for a pilot light or manual ignition is eliminated. The burner also includes a flame sensor 126 and a flame roll-out limit switch 128 which are connected to the system controller 26 to shut down the heater in the event the burner fails to light or the flame rolls out of the flame holder as will be explained in greater detail below.

Mounted adjacent the outlets of the exchanger tubes 80, 82, 84 is the inducer blower 22 which is generally comprised of a low profile squirrel cage impeller 130 and a fan motor 132. The inducer includes an inlet port (not shown) and an exhaust port 134 so that the combusted gases from the burner 16 are drawn through the exchanger tubes 80, 82, 84 through the inducer inlet port and forced out the exhaust port 134. A vent assembly as is common in the industry is connected to the exhaust port to direct the potentially harmful combusted gases out of the heater and to the exterior of the building.

The centrifugal blowers 18, 20 are mounted adjacent the inlet ports in the top shield 68. The blowers are driven by an electric motor 140 mounted on the top shield which forms part of the duct. The three air intake openings 46, 48, 50 provided in the back panel 32 behind the centrifugal blowers 18, 20 permit air to be drawn into the heater and forced through the intake ports of the heat exchanger duct 60. An air filter (not shown) may be mounted between the intake openings 46, 48, 50 and the centrifugal blowers 18, 20 to filter dust and other particulate matter from the air being drawn into the heater 10. In the preferred embodiment, a temperature limit switch 148 is mounted between the centrifugal blowers 18, 20 in the top shield 68 for preventing the heater from exceeding an upper temperature limit as will be explained in greater detail below. The centrifugal blowers 18, 20 are positioned above the return sections of the exchanger tubes 80, 82, 84. Thus, the blowers force a relatively large mass flow rate of air over the return sections in a direction opposite the air flowing through the return sections. Counterflow heat transfer coefficients are higher than parallel flow coefficients. Thus, not only is the entire length of each exchanger tube positioned within the heat exchanger duct so that maximum heat transfer area is achieved, but the heat transfer coefficients at each location in the heat exchanger are maximized by directing larger amounts of air over the exchanger tube return sections. Therefore, a highly efficient heat exchanger is achieved by the configuration of the present invention.

The system control panel 24 is mounted horizontally in the casing immediately below the control access panel 48. The control panel 24 includes an on-off switch 160, a temperature adjustment knob 162 and a light emitting diode (LED) fault indicator 164. The on-off switch 160, temperature adjustment knob 162 and fault indicator 164 are electrically connected to the electronic controller 26 mounted immediately below the system control panel 24. The electronic controller 26 includes a thermostat for measuring the room temperature and determining when the heater should be turned on or off to achieve the temperature setting of the temperature adjustment knob 162. Also included in the controller 26 is a pressure sensor 166 for measuring the pressure drop across the inducer blower 22. If the pressure drop is below a predetermined limit, the controller 26 is signalled as this condition is an indication that the combusted gases are not being properly vented. The light emitting diode (LED) 164 located on the control panel 24 is energized when the controller 26 is signalled that there is insufficient pressure drop to alert the user of the potentially hazardous condition. The fuel to the burners and the power to the blowers is also interrupted when this condition is sensed to prevent buildup of the combusted gases within the heater and building interiors.

A flame sensor circuit is incorporated in the system to sense whether a flame is present in the burner. The previously mentioned flame sensor 126 is connected to the electronic controller 26. If a flame is not present, the sensor 126 sends a signal to the electronic controller 26 which in turn shuts down the heater and energizes the LED fault indicator 164 as previously described.

Also included in the control circuit is the temperature limit switch 148 (see FIG. 2) which assures that the heat exchanger does not become too hot. If the temperature within the heat exchanger exceeds a predetermined limit, the controller 26 is signaled to shut down the heater operation and the LED fault indicator 164 is energized. Likewise, the flame roll-out switch 128 is employed to assure that flame roll-out does not occur in the burner. If the flame should roll out of the burner, the controller 26 is signaled to shut down the heater and the fault indicator 164 is energized. The controller 26 is also equipped with a logic circuit which determines which type of fault has occurred be it failed ignition, over temperature, flame roll out or an insufficient pressure drop through the heat exchanger and sends a different sequence to the fault indicator 164 so that the type of fault can be determined easily by the user.

Figure 3:
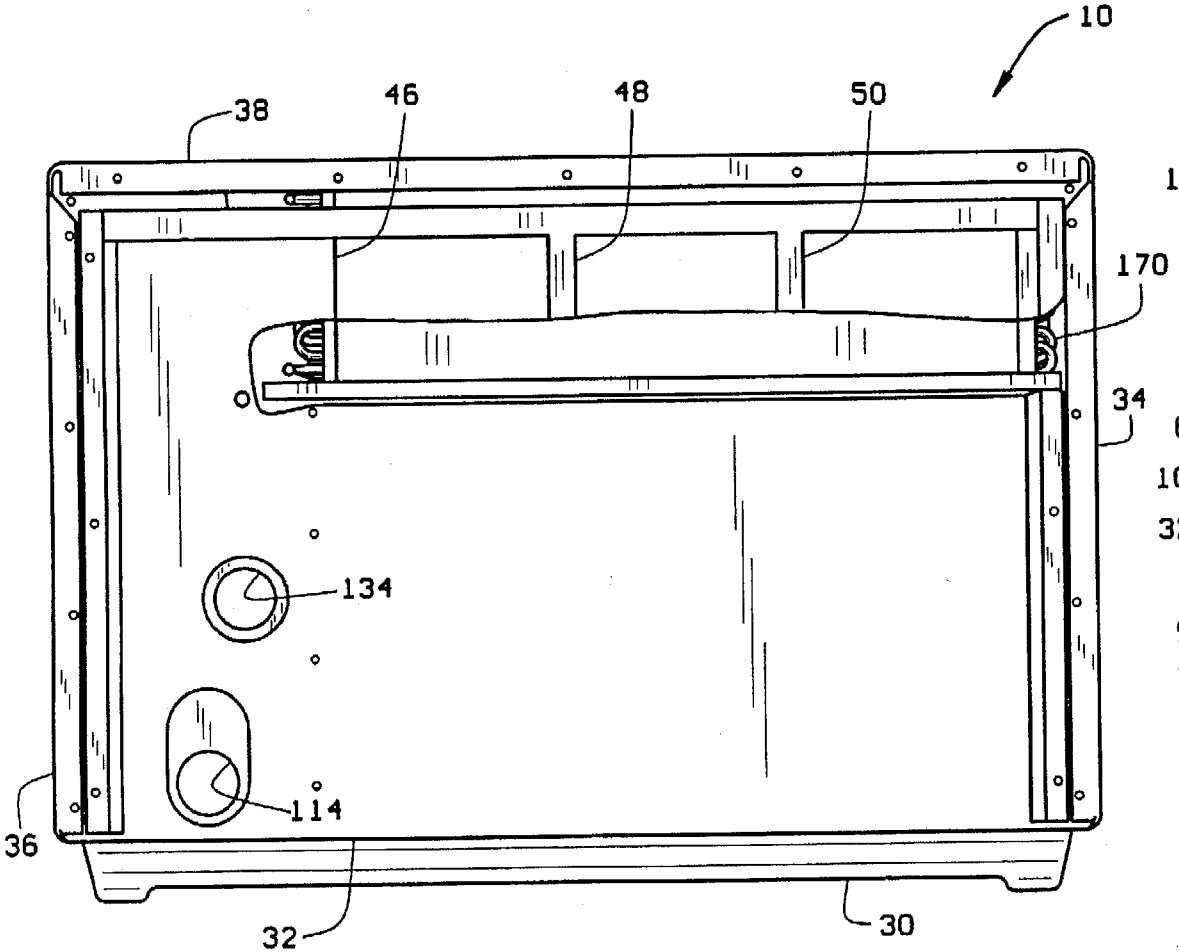
FIG. 3 is a rear elevation view of the heater in partial section.

In addition to providing heat, an optional air conditioning coil (see FIGS. 3 and 4) may be added to the unit between the air filter and centrifugal blowers 18, 20 to cool the air rather than heat it.

During system start-up, the thermostat circuit closes thereby energizing the inducer blower circuit for about fifteen seconds to pre-purge any gas and close the pressure switch. Once the gas is purged, the hot surface ignitor is energized and after an approximately seventeen second warm-up, the gas valve circuit is energized to open the gas valve and ignite the burners. After the burners are lit for about thirty seconds, the circulating air blower comes on, delivering warm air to the room. If ignition does not occur, the ignition sequence is repeated again up to two additional times. If the system does not ignite, the inducer blower, ignitor, gas valve and air blower circuits are de-energized and the LED fault indicator is energized.

After the furnace operates and satisfies the preset temperature of the thermostat, the gas valve closes and the circulating air blower continues to run for about two minutes and then shuts off. The inducer blower runs for about five additional seconds after the air blowers stop to assure that the heater is sufficiently purged of potentially hazardous combustion by-products.

In alternative embodiments, fewer or more exchanger tubes may be employed in the heat exchanger. Likewise, fewer or more orifices and flame holders are used with the one and two tube heat exchanger tube systems. In addition, different exchanger tube configurations may be used without departing from the scope of this invention.

Thus configured, the heater of the present invention provides a compact unit having high thermal efficiency. Thermal gradients across the air output from the heater are minimized thereby eliminating cold spots and improving heater efficiency. Further, because the air is exhausted through the grill near the bottom of the heater, it provides additional comfort to the users as convection permits the heated air to rise throughout the room thereby promoting circulation.

While the present invention has been described by reference to a specific embodiment, it should be understood that modifications and variations of the invention may be constructed without departing from the scope of the invention which is limited only by the scope defined in the following claims.

What is claimed is:

1. A forced air, wall heater comprising a heat exchanger, said heat exchanger including a plurality of tubes with each of said tubes having a plurality of substantially parallel runs and at least one return section between adjacent runs, said return section being generally perpendicular to each of the plurality of runs, and a blower positioned for blowing air directly toward said return section to thereby maximize the mass flow rate of air over said return section.

2. The wall heater of claim 1 wherein a fluid flows through the plurality of heat exchanger tubes, and the blower is positioned for blowing air toward the return section in a direction generally opposite the fluid flow through the return section of the tubes.

3. The wall heater of claim 1 further comprising a second return section positioned between adjacent runs at an end of the adjacent runs opposite the at least one return section, and a second blower positioned for blowing air directly toward said second return section to thereby maximize the mass flow rate of air over said second return section.

4. A forced air, wall heater comprising a heat exchanger, said heat exchanger including a plurality of serpentine tubes, each of said tubes having a plurality of longitudinally extending runs aligned generally perpendicular with a direction of air flow through the exchanger, at least two of said runs of each of said tubes being offset both laterally and in the direction of air flow with respect to each other, and wherein said tubes are nested such that runs in each of said tubes lie on opposite sides of a common plane extending in a direction of air flow.

5. The wall heater of claim 4 wherein the plurality of runs of each of said serpentine tubes includes first, second, third and fourth runs, and the first and third runs are laterally offset with respect to the second and fourth runs.

6. The wall heater of claim 5 wherein the first and third runs of each of said tubes are laterally aligned and the second and fourth runs of each of said tubes are laterally aligned.

7. The wall heater of claim 5 wherein each of the first, second, third and fourth runs of each of said tubes are offset in the direction of air flow.

8. A forced air, wall heater comprising a heat exchanger, said heat exchanger including a plurality of tubes, each of said tubes having a plurality of substantially parallel runs, said substantially parallel runs being substantially horizontally aligned in at least two positions along the heat exchanger, and wherein the ordering of tubes differs in the at least two of said positions.

9. The wall heater of claim 8 wherein the plurality of heat exchanger tubes are nested.

10. The wall heater of claim 9 wherein each of said tubes includes at least two return sections bridging the plurality of substantially parallel runs, and the return sections of one of said tubes are spaced by a greater distance than the return sections of another of said tubes.

11. The wall heater of claim 8 wherein the plurality of runs of each of the serpentine tubes includes first, second, third and fourth longitudinally extending runs, and the first and third runs of each tube are laterally offset with respect to the second and fourth runs of each tube.

12. The wall heater of claim 11 wherein the first and third runs of each tube are laterally aligned and the second and fourth runs of each tube are laterally aligned.

13. The wall heater of claim 11 wherein each of the first, second, third and fourth runs is offset in a direction of air flow from the others of the first, second, third and fourth runs.

14. The wall heater of claim 8 wherein each of said tubes includes at least one return section bridging the plurality of substantially parallel runs.

15. The wall heater of claim 14 wherein each of said return sections are angled with respect to a direction of air flow through the heater.

16. The wall heater of claim 14 wherein each of said return sections on one of said tubes is angled opposite each of said return sections on another of said tubes.

17. The wall heater of claim 10 wherein the runs in the first and second positions are substantially parallel.

* * * * *